US009937500B2

(12) United States Patent
Sutti et al.

(10) Patent No.: US 9,937,500 B2
(45) Date of Patent: Apr. 10, 2018

(54) DRIVING OF JAW CRUSHER ELEMENTS

(75) Inventors: Risto Sutti, Tampere (FI); Jari Jonkka, Kangasala (FI); Marko Salonen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 550 days.

(21) Appl. No.: 14/370,092

(22) PCT Filed: Jan. 3, 2012

(86) PCT No.: PCT/FI2012/050007

§ 371 (c)(1),
(2), (4) Date: Jul. 1, 2014

(87) PCT Pub. No.: WO2013/102695

PCT Pub. Date: Jul. 11, 2013

(65) Prior Publication Data

US 2015/0014454 A1 Jan. 15, 2015

(51) Int. Cl.

| | |
|---|---|
| ***B02C 1/00*** | (2006.01) |
| ***B02C 1/02*** | (2006.01) |
| ***B02C 25/00*** | (2006.01) |
| ***B02C 1/10*** | (2006.01) |

(52) U.S. Cl.

CPC ..... *B02C 1/02* (2013.01); *B02C 1/10* (2013.01); *B02C 25/00* (2013.01)

(58) Field of Classification Search

CPC .. B02C 1/02; B02C 1/10; B02C 1/025; B02C 1/06; B02C 25/00

USPC ..... 241/264, 266, 37, 36

See application file for complete search history.

(56) References Cited

U.S. PATENT DOCUMENTS

| | | | | |
|---|---|---|---|---|
| 4,288,040 | A * | 9/1981 | Miller | B02C 21/02 241/263 |
| 4,398,674 | A * | 8/1983 | Dremann | B02C 1/025 241/264 |
| 4,768,723 | A * | 9/1988 | Fritz | B02C 1/04 241/264 |
| 5,799,888 | A * | 9/1998 | Hamaguchi | B02C 1/025 241/259.1 |
| 6,375,105 | B1 | 4/2002 | Haven et al. | |

(Continued)

FOREIGN PATENT DOCUMENTS

EP 1 803 501 A1 7/2007

OTHER PUBLICATIONS

International Search Report dated Sep. 21, 2012.

*Primary Examiner* — Faye Francis

(74) *Attorney, Agent, or Firm* — Andrus Intellectual Property Law, LLP

(57) ABSTRACT

A jaw crusher including a body, a fixed jaw, a shaft which is arranged horizontally and in direction of a crushing surface of the fixed jaw, and a pitman which is eccentrically movable in relation to the shaft, wherein an electric motor is arranged between the pitman and the shaft. A mineral material processing plant. A method for driving a jaw crusher including a body, a fixed jaw, a shaft which is arranged horizontally and in direction of a crushing surface of the fixed jaw, and a pitman which is forming a crushing chamber with the fixed jaw, the method including moving the shaft eccentrically in relation to the pitman, the method further including the steps of arranging an electric motor between the pitman and the shaft and rotating the shaft by the electric motor.

13 Claims, 5 Drawing Sheets

(56) References Cited

U.S. PATENT DOCUMENTS

| | | | | |
|---|---|---|---|---|
| 6,915,972 | B2 * | 7/2005 | Rossi, Jr. | B02C 1/02 241/101.72 |
| 9,586,209 | B2 * | 3/2017 | Rikkonen | B02C 1/02 |
| 2004/0050986 | A1 * | 3/2004 | Rossi, Jr. | B02C 1/02 241/101.73 |
| 2004/0124295 | A1 * | 7/2004 | Sugimura | B02C 1/025 241/264 |
| 2012/0018558 | A1 * | 1/2012 | Gervais | B02C 1/04 241/101.74 |
| 2012/0199680 | A1 * | 8/2012 | Ueda | B02C 1/10 241/267 |
| 2013/0092769 | A1 * | 4/2013 | Schenk | B02C 1/02 241/24.12 |
| 2014/0166791 | A1 * | 6/2014 | Tjell | B02C 1/02 241/30 |
| 2015/0014454 | A1 * | 1/2015 | Sutti | B02C 1/10 241/30 |
| 2015/0238970 | A1 * | 8/2015 | Nakayama | B02C 1/02 241/264 |

* cited by examiner

DRIVING OF JAW CRUSHER ELEMENTS

CROSS-REFERENCE TO RELATED APPLICATIONS

This application claims priority to PCT/FI2012/050007, filed Jan. 3, 2012, and published in English on Jul. 11, 2013 as publication number WO 2013/102695, incorporated herein by reference.

TECHNICAL FIELD

The present invention generally relates to driving of rotating crusher elements. The invention relates particularly, though not exclusively, to driving of jaw crusher elements crushing mineral-based materials.

BACKGROUND ART

Mineral material such as rock is gained from the earth for crushing by exploding or excavating. Rock can also be natural and gravel or construction waste. Mobile crushers and stationary crushers are used in crushing. An excavator or wheeled loader loads the material to be crushed into the crusher's feed hopper from where the material to be crushed may fall in a jaw of a crusher or a feeder moves the rock material towards the crusher. The mineral material to be crushed may also be recyclable material such as concrete, bricks or asphalt.

Mineral crushers typically operate using an electric motor that drives a crusher element through a power transmission system. A typical crusher comprises a body that supports a crushing unit, an electric motor and power transmission, such as a belt and a pair of belt wheels.

FIG. 1*a* shows an example of a jaw crusher 20. jaw crushers a suitable for example coarse crushing at quarries or for crushing of construction material. According to the function principle of the jaw crusher the crushing takes place against jaws, the so called fixed and movable jaw (a pitman). The body 1 of the jaw crusher is formed of a front end and a rear end and side plates. The fixed jaw 9 is attached to the front end of the jaw crusher which is receiving the crushing forces. The movable jaw 8 is attached to a pitman 4 and the movement of the pitman is generated by rotating an eccentric shaft 5. The jaw crusher comprises additionally a belt wheel 13, V-belts 12, a motor 11 and a belt wheel of the motor for moving the movable jaw 8. Mineral material is crushed between the jaws 8, 9 and is proceeding after the crushing for example via a belt conveyor to further processing.

The jaw crusher 20 comprises further an adjusting apparatus 2 for changing the working angle of the pitman 4 which adjusting apparatus is connected to the pitman via a toggle plate 6. A return rod 7 and a return spring 10 are pulling the pitman towards the adjusting apparatus and at the same time keeping the clearances as small as possible at both ends of the toggle plate.

FIG. 1*b* shows an example of a track-mounted mobile jaw crushing station 30. The crushing station comprises a body 21 and tracks 22 for moving the crushing plant, a feeder 23 such as a vibrating feeder for feeding material into a jaw crusher 20 and an output conveyor 25 such as a belt conveyor for conveying material for example to the following crushing phase, a motor 11, motor's belt wheel 15, crushing unit's belt wheel 13 and a belt 12. The crushing station comprises also a motor unit 24 comprising for example a diesel motor.

V-belts 12 and belt wheels 13 and 15 are used for coupling the power source to the jaw crusher in prior art. The motor 11 such as a hydraulic or an electric motor is fixed typically to the body of the jaw crusher directly or by a separate motor bed (reference 14 in FIG. 1*a*) which is a subframe between the body 1 of the jaw crusher and the motor 11. Alternatively the motor is fixed to the body 21 of the crushing station 30 by means of a corresponding subframe 34.

It appears clearly in FIGS. 1*a* and 1*b* that the belt-based power transmission and the motor reserve substantial space and increase the size of the crusher. Moreover, to reduce peak strains on the belt, the crushing unit is provided with a flywheel. The belt-based power transmission also requires protective covering around the belt and belt wheels to avoid injuries of the users. The belt-based power transmission also easily excites resonant vibration through the body to associated material conveyors. The resonant vibration causes noise and incurs substantial stress in various structures and therefore heavier and more robust implementation are needed both in the crushing unit itself, in the body of the crusher and in various other structures connected to the crushing unit.

It is an object of the invention to avoid or mitigate problems related to prior known crushers or at least to advance the technology by developing new alternatives to known technologies.

SUMMARY

According to a first example aspect of the invention there is provided a jaw crusher comprising a body, a fixed jaw, a shaft which is arranged horizontally and in direction of the fixed jaw, and a pitman which is eccentrically movable in relation to the shaft, wherein an electric motor is arranged between the pitman and the shaft.

The electric motor may be attached to the shaft and configured to proceed the pitman in a movement in relation to the shaft.

A rotor of the electric motor may be connected to one of the following: the shaft and the pitman, and a stator of the electric motor may be connected to the other of said shaft and pitman.

Preferably a rotor part of the electric motor is fixed to the shaft and a stator part of the electric motor is fixed to the pitman.

Preferably the jaw crusher comprises a mass wheel (flywheel) at least in one end of the shaft and the rotor of the electric motor is fixed to the mass wheel.

Preferably the stator is around the rotor and the stator is fixed to the body.

Preferably the electric motor is a permanent magnet motor. A permanent magnet motor provides for a good efficiency and a good torsion moment (torque) already by low rotation speed.

According to a fourth example aspect of the invention there is provided a mineral material processing plant comprising a body construction to which body construction is attached a jaw crusher for mineral material crushing and at least one conveyor for conveying crushed mineral material, which jaw crusher comprises a body, a fixed jaw, a shaft which is arranged horizontally and in direction of the fixed jaw, and a pitman which is eccentrically movable in relation to the shaft, wherein an electric motor is arranged between the pitman and the shaft and configured to proceed the pitman in a movement in relation to the shaft.

According to a fifth example aspect of the invention there is provided a method for driving a jaw crusher comprising a body, a fixed jaw, a shaft which is arranged horizontally and in direction of a crushing surface of the fixed jaw, and a pitman which is forming a crushing chamber with the fixed jaw, the method comprising moving the shaft eccentrically in relation to the pitman, the method further comprising arranging an electric motor between the pitman and the shaft and rotating the shaft by the electric motor.

Preferably the method comprises driving the pitman in a first direction, measuring a drive current of the electric motor and driving the pitman to a second reversed direction if the measured drive current of the electric motor exceeds a predetermined threshold current level.

Preferably the method comprises driving the pitman in the second direction, measuring a drive current of the electric motor and driving the pitman in the first direction if the measured drive current of the electric motor exceeds a predetermined threshold current level.

Preferably the method comprises increasing the setting of the fixed jaw and the pitman.

Further the motor bed, wearing belts, belt wheels and machined grooves of the flywheel may not be required any longer. Design, manufacturing and service costs of crushers and crushing plants are decreasing because there may be no requirement for belts, separate motors beds or motor fixing attachments in crushers and crushing plants. The current bearings of the eccentric may be sufficient, the amount of bearings may be decreasing and there may required no wearing parts such as carbon brushes which is increasing the life of the crushing apparatus. In a jaw crusher the current return rod is sufficient for the torque support. The permanent magnet motor has a large torque in relation to the traditional electric motor and this is an advantage when the jaw crusher is started with a full jaw.

In preferred embodiments it is easy to change the direction the crusher element. Due to the direct drive there are less power losses.

The design of a movable processing plant is getting easier and there will be more freedom for positioning the components.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the invention will be described with reference to the accompanying drawings, in which.

DETAILED DESCRIPTION

In the following description, like reference signs denote like elements.

Figure 1A:
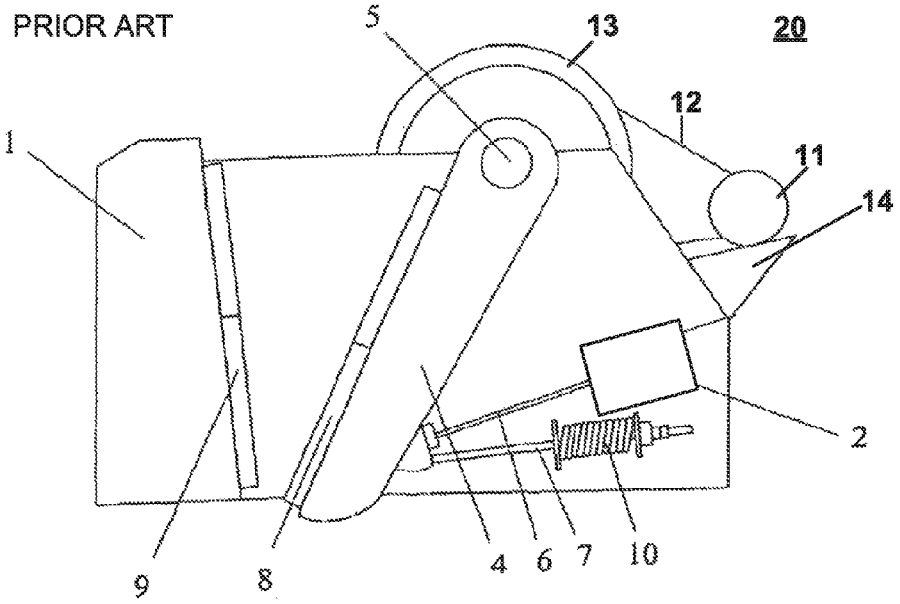
FIG. 1*a* shows prior art jaw crusher.
Figure 1B:
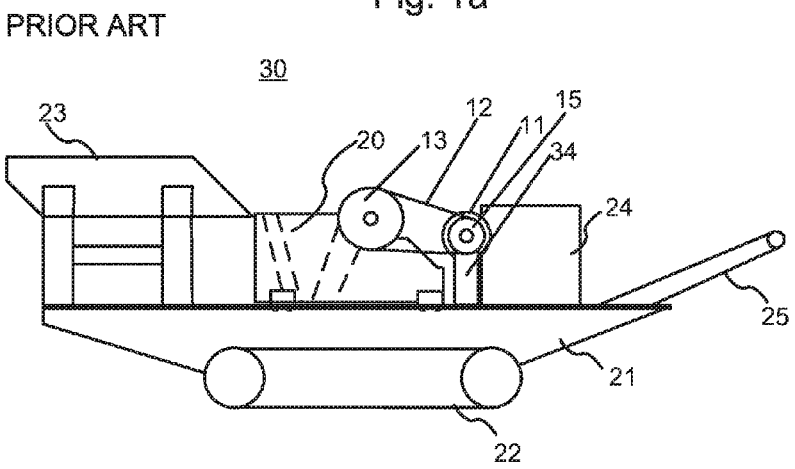
FIG. 1*b* shows a prior art track-mounted mobile jaw crushing station.
Figure 2A:
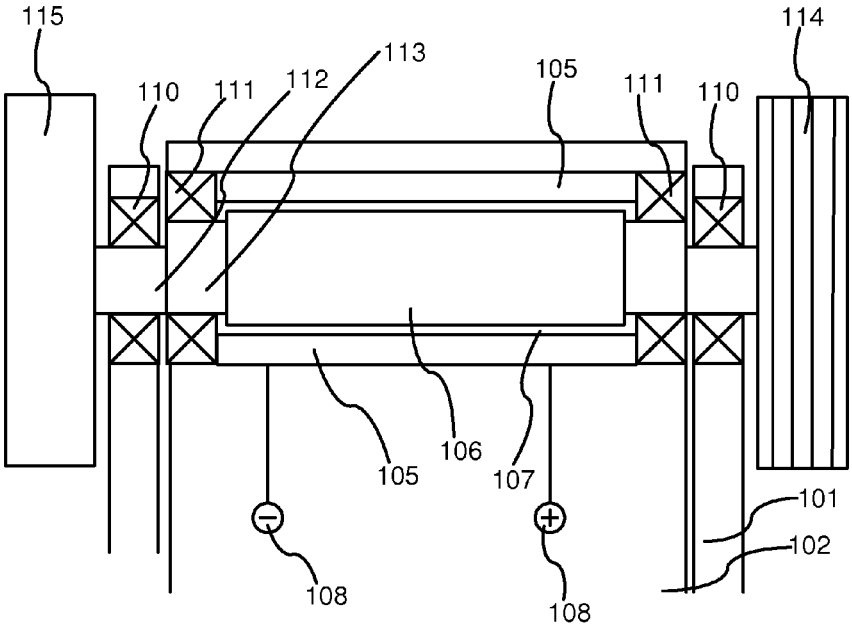
FIG. 2*a* shows a first apparatus according to an example embodiment.

FIG. 2*a* shows a cross section of a first apparatus, a jaw crusher, according to an example embodiment. The crusher comprises a body 101 and a pitman 102 (a rotating crusher element) and a movable crushing blade is fixed to the pitman. A shaft 112 (a rotating axle) is supported to the body 101 by means of first bearings 110 enabling rotating of the shaft around its longitudal axis. The shaft 112 comprises an eccentric portion 113 which is supported to the pitman 102 via second bearings 111 enabling changing the rotation movement which is generated by the rotation of the shaft to a back and forth movement in a known way. Further the crusher comprises two mass wheels 114 and 115 (flywheels) for generating the moment required in the crushing.

Further the jaw crusher comprises an electric motor 105-108 which is arranged inside the pitman 102 around the shaft, the electric motor comprising a stator 105, a rotor 106, an insulation gap such as an air gap 107 between the rotor 106 and the stator 105 and electric wires 108 for the coils of the stator (not shown in the Figure). In an embodiment according to the invention the rotor part 106 is fixed around the eccentric portion 113 of the shaft 112. For example a bolt joint, cold or hot shrinkage joining, soldering, welding or bonding can be used as joining methods for the rotor part 106. The stator 105 is fixed in a cylindrical opening which is made (for example machined) inside the pitman 102 in a region between the second bearings 111. Preferably the rotor 106 comprises permanent magnets wherein coils and wires for generating a magnetic field are not required.

Electric wires 108 relating to the coils of the stator 105 are preferably brought on a rear surface of the pitman 102.

The cooling required by the electric motor 105-108 can be ensured by making for example a cooling rib construction on the rear surface and/or an upper surface of the pitman in immediate vicinity of the electric motor.

The jaw crusher according to the invention provides a higher torque than known solutions what enables starting of the crushing even then when there is material to be crushed in the jaw of the crusher.

The electric motor enables changing the rotation direction of the pitman when a suitable control electronics is used.

In an embodiment of the invention the width of the stator 105 is 600 mm, the outer diameter 600 mm and the inner diameter circa 400 mm. The outer diameter of the rotor 106 is circa 400 and the inner diameter 340 mm. The air gap 107 between the rotor and the stator is circa 1 mm. The power of the motor according to the above dimensions is 132 kW with a rotation speed n=230 l/min and torque M=5500 Nm.

Figure 2B:
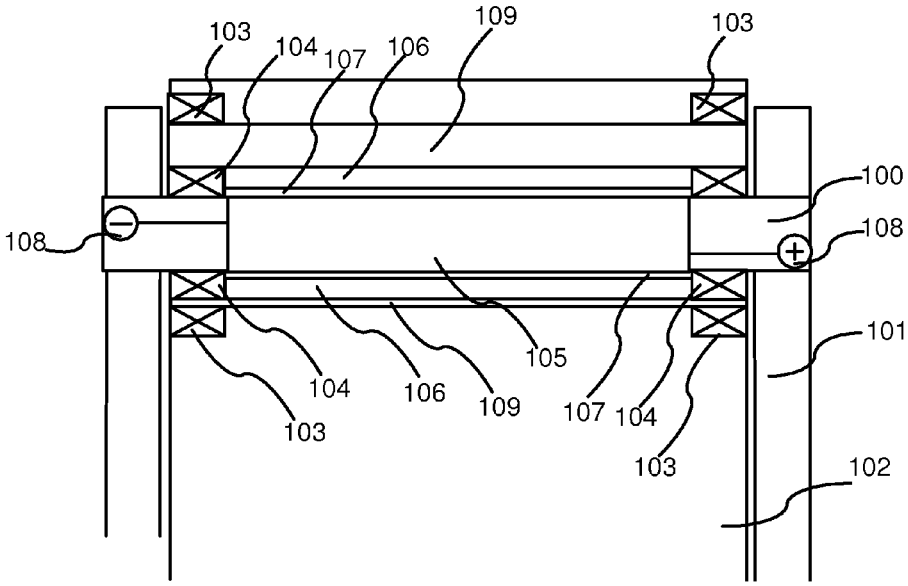
FIG. 2*b* shows a second apparatus according to an example embodiment.

FIG. 2*b* shows a cross section of a second apparatus, a jaw crusher, according to an example embodiment. This embodiment is differing from the example of FIG. 2*a* in that the shaft 100 (a core shaft) is now fixed at its both ends in relation to the body 101 wherein the shaft is acting as the stator 105 of the electric motor. It is preferable to bring the electric wires 108 relating to the coils of the stator 105 via the shaft 100 to the outer periphery of the crusher for example through channels machined to the shaft 100.

The rotor 106 of the electric motor which comprises preferably permanent magnets is fixed to an eccentric cylinder 109 at a distance of an insulation gap 107 from the shaft 100. The eccentric cylinder 109 (a tubular member configured to rotate about the core shaft, e.g. a bushing) is supported by third bearings 104 to the shaft and by fourth bearings 103 to the pitman 102. This arrangement enables a rotation movement of the eccentric cylinder around the shaft 100 and the back and forth movement of the pitman.

Because there are no separate mass wheels in this embodiment a sufficient momentum has to be generated by the electric motor and the pitman. In order to increase the momentum the mass of the pitman can be increased by casting the pitman in one part or by fixing further masses to the pitman 102.

Figure 2C:
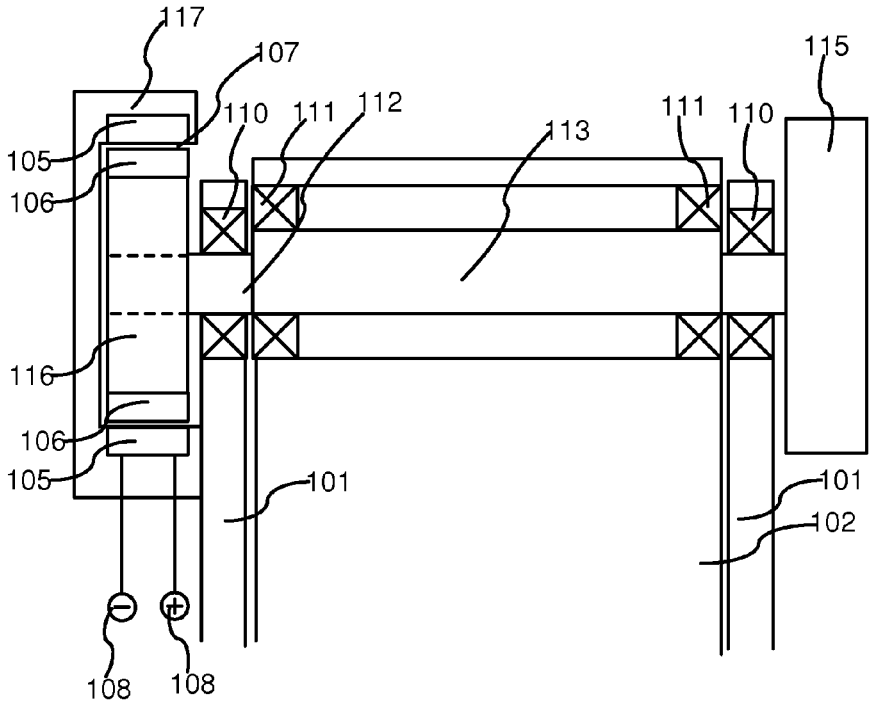
FIG. 2*c* shows a third apparatus according to an example embodiment.

FIG. 2*c* shows a cross section of a third apparatus, a jaw crusher, according to an example embodiment where the embodiment in relation to the construction of the pitman 102 and the eccentric 113 is according to FIG. 2*a* but the electric motor is located between a first mass wheel 116 and a first support structure 117 surrounding the mass wheel. The rotor 106 is fixed on an outer surface of the first mass wheel 116 and the stator 105 is fixed on an inner circumference of the first support structure 117 and the first support structure is fixed to the body 101 of the jaw crusher, preferably to a side portion, for example to the side plate. The electric wires 108 of the stator 106 can preferably be brought through the first support structure 117 at an outer surface of the first support structure where an appropriate electric coupling can be arranged.

Figure 2D:
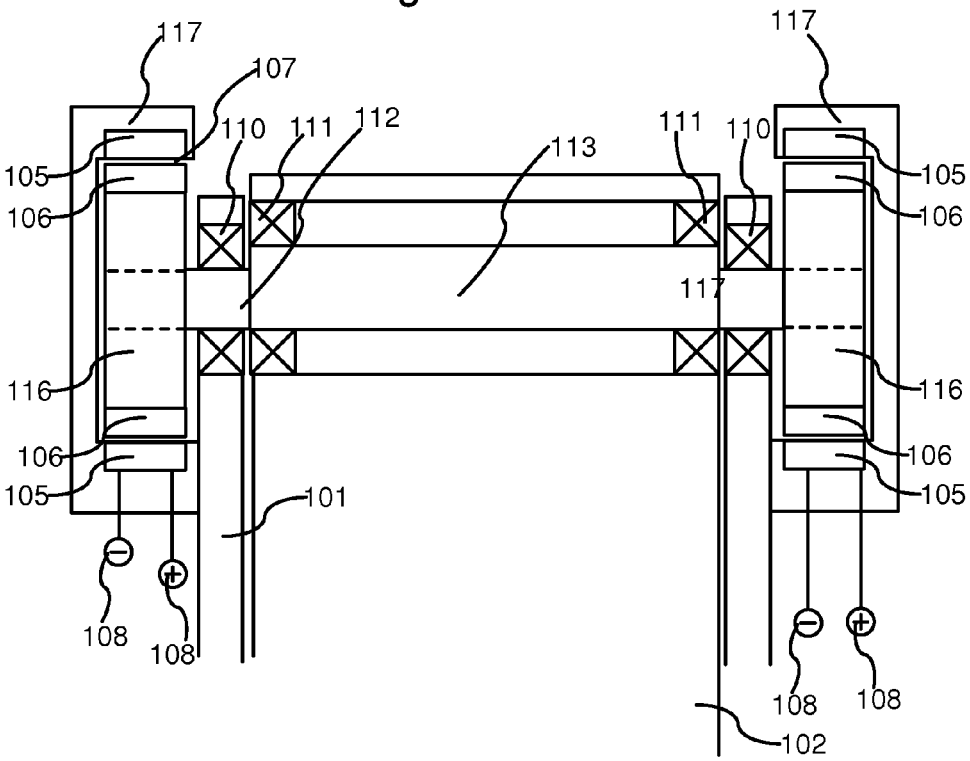
FIG. 2*d* shows a fourth apparatus according to an example embodiment.

FIG. 2*d* shows a fourth apparatus, a jaw crusher, according to an example embodiment. FIG. 2*d* shows an alternative embodiment for the embodiment of FIG. 2*c*. In this embodiment two electric motors are arranged on the shaft, each of them on one mass wheel fixed at the ends of the shaft. This embodiment provides a higher torque than in the solution of FIG. 2*c* or the motors can be lower in power than the motor of FIG. 2*c*. The torque is distributed more evenly because the forces are directed substantially equally on both sides of the crusher.

Due to the support structures shown in FIGS. 2*c* and 2*d* a separate cover around the mass wheels is not required any longer with the exception of the second mass wheel 115 of FIG. 2*c* because the support structure itself can be designed so that it covers totally the driving mass wheel 116. In case the electric motor is used in very hot circumstances or the electric motor requires cooling the mass wheel 116 may be designed so that during rotation movement the mass wheel is blowing or sucking cooling air through cooling openings which are arranged in the support structure (not shown in the Figure).

Figure 3:
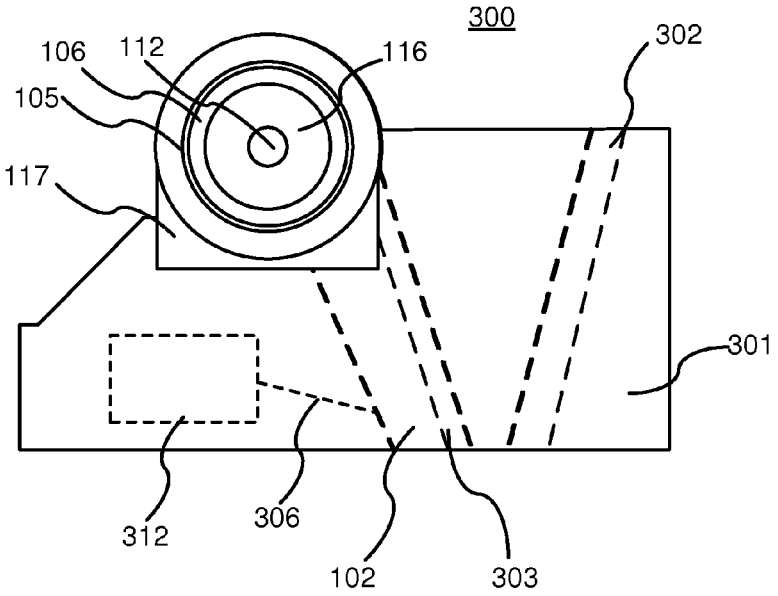
FIG. 3 shows a jaw crusher according to an embodiment of the invention.

FIG. 3 shows a jaw crusher 300 according to an embodiment of the invention comprising a body 301, a fixed jaw 302, preferably comprising a stationary crushing member, and a movable crushing member 303 which are forming a jaw of the crusher. The movable crushing member is fixed to the pitman 102 which is moving back and forth with a circumferential symmetric movement by means of the eccentric and the shaft 112 when viewed at the upper end of the pitman.

Additionally the crusher comprises a toggle plate 306 for supporting the pitman to the body of the crusher and adjusting means 312 for adjusting the setting of the crusher i.e. the closed side setting (minimum distance) of the stationary and movable crushing members (the fixed jaw and the pitman).

The crusher comprises additionally an electric motor 105, 106, 116, 117 according to some embodiment of the invention. The electric motor is arranged substantially in connection with the shaft and/or pitman of the crusher.

The body of the jaw crusher may be implemented in many ways. The body may be casted, welded or mounted with bolt joints of one or several parts. The jaw crusher may comprise a front end and separate plate-like side parts and a rear part. The support structures 117 according to FIGS. 2*c* and 2*d* can be fixed to the side parts such as side plates and/or the rear part at the side of the pitman.

The construction of the jaw crusher can be simplified because the power source is not required to couple through the V-belts to the belt wheel of the crusher and a known separate motor bed is not required.

Figure 4:
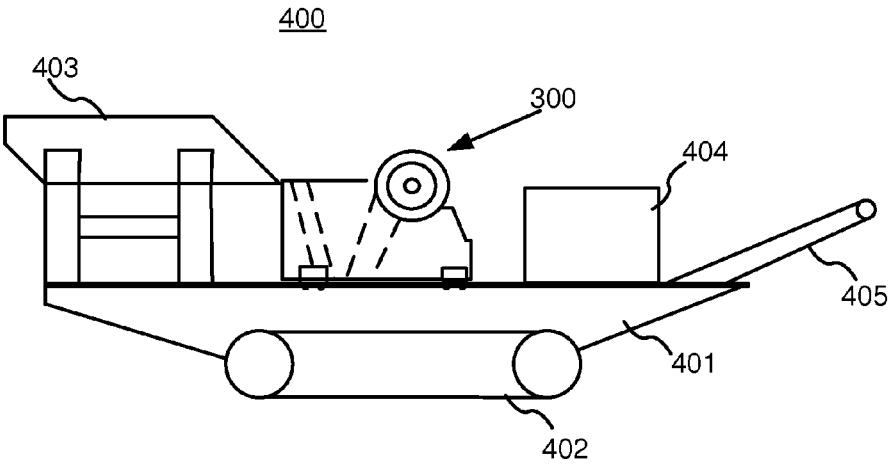
FIG. 4 shows a mobile crushing station according to an example embodiment.

FIG. 4 shows a mobile crushing station 400 (a processing plant) according to an example embodiment. The mobile crushing station 400 comprises a body 401 and traction elements 402 connected on both sides of the body 401 for moving the mobile crushing station 400. Fixed to the body 401 there are also, in series, an input feeder 403 such as a vibration feeder, a crusher such as the jaw crusher 300, and an output conveyor 405 for removing crushed material. Also carried by the body 401 there is a power station 404 configured to provide operating power for different power-dependent elements of the mobile crushing station 400, such as the input feeder, crusher 300, output conveyor 405 and for the traction elements 402. The power station 404 comprises, in one example embodiment, an engine such as a petrol engine, diesel engine or fuel cell engine. For using an electric motor to drive the crusher 300, the power station 404 further comprises a generator. If, on the other hand, the motor in the crusher is a pneumatic or hydraulic motor, the power station 404 comprises a corresponding pneumatic or hydraulic pump. The feeder may also comprise a scalper. The crushing station may also comprise one or more screens such as a multi-deck screen. Preferably the feeder comprises also at least one output conveyor for conveying the crushed or screened material for example to a pile or to a following crushing or screening phase. The processing station 400 may be a stationary plant or movable for instance by means of wheels, tracks, legs or runners.

The body 401 and a track base 402 enable an independent movement of the processing plant of the example for instance from a transport carriage to the crushing site. When the mineral material processing plant is wheel based the base may be constructed such as a trailer of a truck wherein the base may be moved by a truck, an excavator, a loader or another device.

Operation of the processing plant is described in the following. The material to be crushed is brought to the feeder 403 by for example a loader or an excavator. The feeder (which typically is acting according to the principle of an eccentric) feeds the material towards the jaw of the jaw crusher 300. In case there is a scalper and/or a screen in connection with the feeder the fine fraction may be separated and lead directly to the output conveyor 405 or the fine material may be conveyed to be screened to a screening means of the processing plant such as a multi-deck screen.

Figure 5:
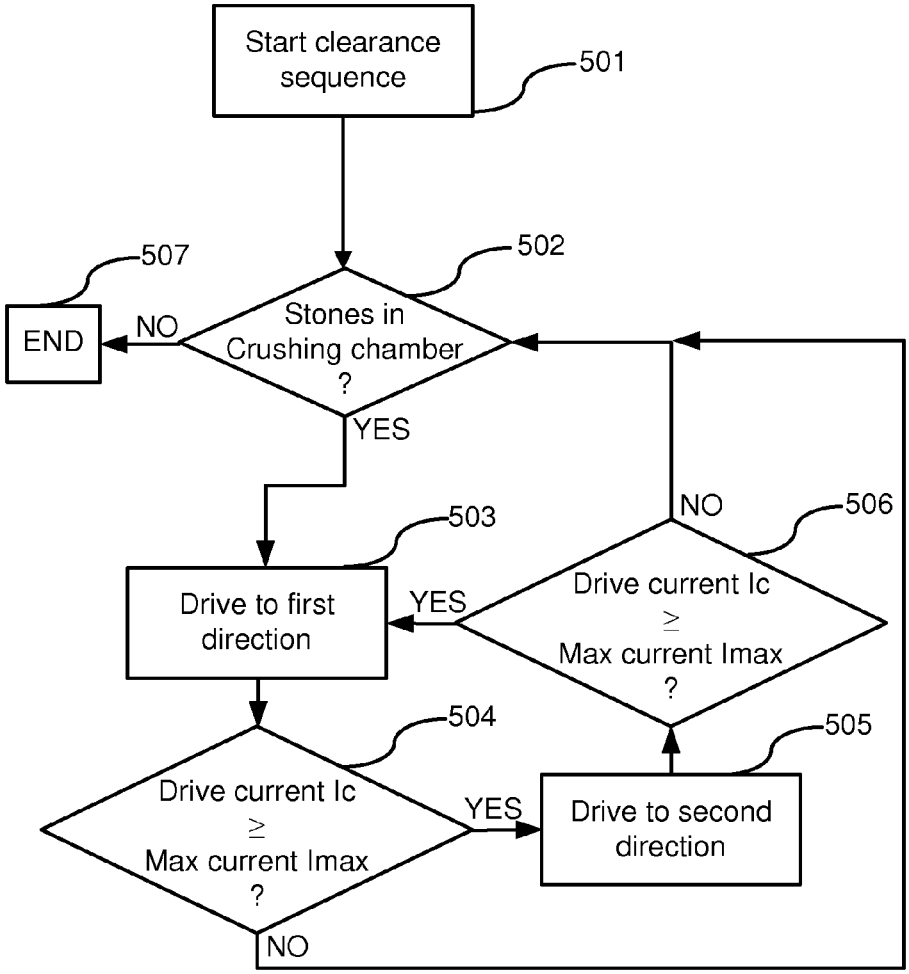
FIG. 5 shows a diagram of an exemplary method according to an embodiment of the invention.

Driving of a jaw crusher according to the invention is disclosed in the following by referring to FIG. 5. The following can be illustrated as a normal use of the jaw crusher or can be understood as a separate sequence, such as a crushing chamber clearing sequence where superfluous material is emptied from the crushing chamber.

During crushing event there might come up situations, wherein it might be desirable to change rotation direction of a pitman. One of such an example is when the crusher stalls due to amount of material in the crushing chamber. Also the shape and size of crushed material may cause situations, where reversible driving might come into question.

At step 501 crushing process or a separate crushing chamber clearance sequence is started. At step 502 it is detected if there are any stones in the crushing chamber. Proceeding next to step 503, wherein the pitman is driven to a first direction, which is a normal crushing direction of the pitman. At step 504 after a predetermined time the flow proceeds to step 502, unless a drive current Ic of the electric motor exceeds a predetermined threshold current level (Imax). In this case the flow proceeds to step 505, wherein the rotation direction of the pitman is changed (second direction). At step 506 after a predetermined time the flow proceeds to step 502, unless the drive current Ic of the electric motor again exceeds the predetermined current level (Imax). Now the flow proceeds to step 503 and the sequence 503-506 is repeated until the crushing chamber is cleared. After the clearance sequence a normal crushing sequence 502, 503, 504 is achieved. If it is detected at step 502 that the crushing chamber is empty, the flow may proceed to step 507, wherein the crusher is stopped.

In conjunction of step 502, 503 and/or step 505 also the setting of the crusher can be increased, e.g. by gradually step by step increasing the closed side setting towards the maximum value, in order to increase the volume of the crushing chamber and to get over the abnormal situation.

Different example embodiments of the present invention provide various technical effects and advantages. For instance, external belts and pulleys need not be provided for driving of the crusher element. Further still, energy efficiency may be greatly improved by removing the need of further bearings, power transmission elements and/or clutch elements. Moreover, by avoiding e.g. clutch elements between the rotor of the motor and the crusher element may also reduce vibrations, noise, power loss and maintenance needs.

Further advantageously, noise and vibration can be damped by the mass of the crusher element and by the crushing material when the drive shaft arrangement is configured to form for the rotor the rotating axle that is rigidly coupled with the rotating crusher element.

The crushing material may conduct heat away from the motor for example in embodiments where the motor is built in the rotating crusher element and where the rotating crusher element contacts the crushing material.

The rotor of the motor may be integrally formed with the rotating crusher element, see e.g. FIGS. 2*a* to 2*d*.

Advantageously, a permanent magnet motor may tolerate relative movements between the rotor and the stator of the motor caused by crusher elements through the rigid coupling with the common drive shaft arrangement. Moreover, the permanent magnet motor may provide sufficient torque at low speeds to enable starting of the apparatus without necessarily first clearing the apparatus of crushing material.

Still further advantageously, total mass of the apparatus and/or the number of different bearings may be reduced in comparison to existing crushers using e.g. belt based power transmission from a bed-mounted motor with a belt and belt wheels.

The rotating crusher element may comprise an exterior surface configured to contact crushing material when in operation.

The body may form side walls and ends of the rotating crusher element may be supported by respective side walls. The motor may be entirely formed inside the crusher element. Thus, the crusher may be made compact so removing need for space to accommodate either the motor or any power transmission outside the body of the apparatus. Moreover, by forming the motor inside the crusher element, separate protective parts are not needed to prevent access to dangerous parts in power transmission. Still further, by forming the motor inside the crusher element, there is no motor or power transmission exposed to damaging e.g. by erroneous use of a digger feeding crushing material to the apparatus or during transport of the apparatus.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A jaw crusher comprising:

a body, a fixed jaw, a shaft which is arranged horizontally and spaced from a crushing surface of the fixed jaw, a pitman which is eccentrically movable in relation to the shaft; and an electric motor operatively positioned within the pitman and located around the shaft such that the electric motor directly drives the movement of the pitman.

2. The apparatus of claim 1, wherein the electric motor is attached to the shaft and configured to drive the pitman in a movement in relation to the shaft.

3. The apparatus of claim 2, wherein a rotor of the electric motor is connected to the shaft and a stator of the electric motor is connected to the pitman.

4. The apparatus of claim 2, wherein a rotor part of the electric motor is fixed to the shaft and a stator part of the electric motor is fixed to the pitman.

5. The apparatus of claim 2, wherein a rotor of the electric motor is connected to the pitman and a stator of the electric motor is connected to the shaft.

6. The apparatus of claim 1, wherein the jaw crusher comprises a mass wheel at least in one end of the shaft and a rotor of the electric motor is fixed to the mass wheel.

7. The apparatus of claim 1, wherein a stator of the electric motor is around a rotor of the electric motor and the stator is fixed to the body.

8. The apparatus of claim 1, wherein the electric motor is a permanent magnet motor.

9. A mineral material processing plant comprising:

a body construction to which body construction is attached a jaw crusher for mineral material crushing; and at least one conveyor for conveying crushed mineral material, wherein the jaw crusher further comprises:

a body, a fixed jaw, a shaft which is arranged horizontally and spaced from the fixed jaw, a pitman which is eccentrically movable in relation to the shaft; and an electric motor operatively positioned within the pitman and located around the shaft such that the electric motor directly drives the movement of the pitman.

10. A method for driving a jaw crusher comprising the steps of:

providing a jaw crusher including a body, a fixed jaw, a shaft arranged horizontally and spaced from a crushing surface of the fixed jaw, and a pitman that forms a crushing chamber with the fixed jaw;

positioning an electric motor within the pitman and located around the shaft; and operating the electric motor to directly rotate the shaft, wherein rotation of the shaft moves the pitman eccentrically in relation to the shaft.

11. The method according to claim 10 further comprising the steps of driving the pitman in a first direction, measuring a drive current (Ic) of the electric motor and driving the pitman to a second reversed direction if the measured drive current (Ic) of the electric motor exceeds a predetermined threshold current level (Imax).

12. The method according to claim 11 further comprising the steps of driving the pitman in the second direction, measuring a drive current (Ic) of the electric motor and driving the pitman in the first direction if the measured drive current of the electric motor exceeds a predetermined threshold current level (Imax).

13. The method according to claim 11 further comprising the steps of increasing the setting of the fixed jaw and the pitman.

* * * * *